United States Patent [19]

Tremblay, deceased

[11] Patent Number: 5,062,376

[45] Date of Patent: Nov. 5, 1991

[54] ANCHORING DEVICE FOR LIGHT BOAT

[75] Inventor: Michel Tremblay, deceased, late of Val Bélair, Canada, by Francine Paquet, heiress

[73] Assignee: Gestion A. et Y. Gilbert Inc., Québec, Canada

[21] Appl. No.: 631,149

[22] Filed: Dec. 20, 1990

[51] Int. Cl.[5] ..... B63B 21/50

[52] U.S. Cl. ..... 114/230; 114/293

[58] Field of Search ..... 114/230, 293, 294; 254/304

[56] References Cited

U.S. PATENT DOCUMENTS

| | | | |
|---|---|---|---|
| 2,526,953 | 10/1950 | Kruse | 254/304 |
| 2,952,236 | 9/1960 | Moses | 114/230 |
| 3,051,448 | 8/1962 | Pletta | 114/230 |
| 3,187,706 | 6/1965 | Ross | 114/230 |
| 3,395,668 | 8/1968 | George | 114/294 |

*Primary Examiner*—Jesus D. Sotelo
*Assistant Examiner*—Stephen P. Avila
*Attorney, Agent, or Firm*—Robic

[57] ABSTRACT

An anchoring device for mounting on a boat, particularly a light boat used for sporting purposes. It has a pair of aligned winch drums with cables wound on them into rolls for winding and unwinding in opposite directions; the drums being mounted on a frame for rotation about parallel axes. A manually operable drive is mounted on the frame and on the drums, which drive allows them to be rotated and, in a neutral position, allows them to idle. A manually releasable stop member mounted on the frame cooperates with the drive to stop rotation of the drums so as to prevent the cable from unwinding.

18 Claims, 3 Drawing Sheets

ANCHORING DEVICE FOR LIGHT BOAT

BACKGROUND OF THE INVENTION

1. Field of the Invention

The present invention relates to an anchoring device for mounting on a boat, more particularly on a sideboard of a light boat used for sporting purposes.

2. Description of the Prior Art

Light boats used presently for sport fishing, for instance, are held in position by a pair of anchors dropped to the bottom of the piece of water and raised by hands. Apart from the fact that the operation is tedious and time-consuming, it assumes that if only one fisherman is on board the boat, he has to move between fore and aft to achieve it, which presents the possibility of the boat capsizing. Apart from that, while one anchor is being dropped, the boat may shift from the desired longitudinal orientation; this being particularly so considering that some time may be needed to tie the loose ends of the ropes to the boat, ensuring that all slack is taken up.

SUMMARY OF THE INVENTION

An object of the present invention is to propose an anchoring device for mounting in a particular location on one of the sideboards of a light boat and from which single location the anchors can be handled such as, particularly, be simultaneously dropped thereby preventing the boat from deviating from a selected axial orientation.

Another object is to provide such a device that will continuously control and eventually break off the momentum picked up by the winch drums over which the cables are wound, when the anchors reach the bottom of the water, thus avoiding unwinding unnecessary lengths of cables that would cause undesired slack.

Still another object of the invention lies in the provision of such a device that can be operated wholly by hands and without any difficulties while remaining at the same single location on the boat.

More specifically, the anchoring device of the invention essentially comprises:

a frame;

a pair of winch drums and cables for attaching to anchors, the cables being wound into rolls on the drums for winding and unwinding in opposite directions;

means rotatably mounting the drums on the frame;

manually operable means on the drums and on the frame for rotating the drums and, in neutral position of the operable means, for allowing the drums to idle; and manually releasable stopping means on the frame for stopping rotation of the drums to prevent the cables from unwinding therefrom, wherein the manually operable means comprise:

a first driven gear fixed to one of the drums and a second driven gear fixed to the other of the drums;

an operating shaft mounted for rotation and axial displacement on the frame and having a pair of pinions fixed thereto;

means controlling the axial displacement of the shaft between a first position wherein one of the pinions meshes with the first driven gear; a second position wherein both of the pinions are free of the gears; and a third position wherein the other of the pinions meshes with the second driven gear.

In a first preferred embodiment, of the invention, each drum comprises a pair of parallel cheek disks; the driven gears of the manually operable means are fixed to one of these cheek disks; and the manually releasable stopping means comprise, for each of the drums, a pawl member pivotally mounted on the frame for engaging with a tooth of the driven gear, and means biasing the pawl against the driven gear.

In another preferred embodiment of the invention, each drum comprises a pair of parallel cheek disks; the driven gears of the manually operable means are externally fixed to one of these cheek disks; and the manually releasable stopping means comprise, for each of the drums, a friction lining pad mounted onto an operating lever and means acting on the lever to bias the pad against the external surface of other cheek disk. By acting on the lever against the action of the biasing means, one may release the friction of the pad and thus make the corresponding drum free to rotate.

In a further preferred embodiment of the invention, the anchoring device may also comprise momentum breaking means on the frame acting on the cable rolls and capable of stopping the drums for allowing the drums to loose the momentum when anchors carried by the cables come to a sudden stop. Such means may comprise a pair of friction arms, each arm having one end mounted on the frame for pivotal movement about an axis parallel to the axes of the drums and the other end frictionally applied over the cable roll of one of the drums, and resilient means biasing the arms against the rolls.

A description of two preferred embodiment of the invention will now follow, having reference to the appended drawings.

DESCRIPTION OF THE PREFERRED EMBODIMENTS

Figure 1:
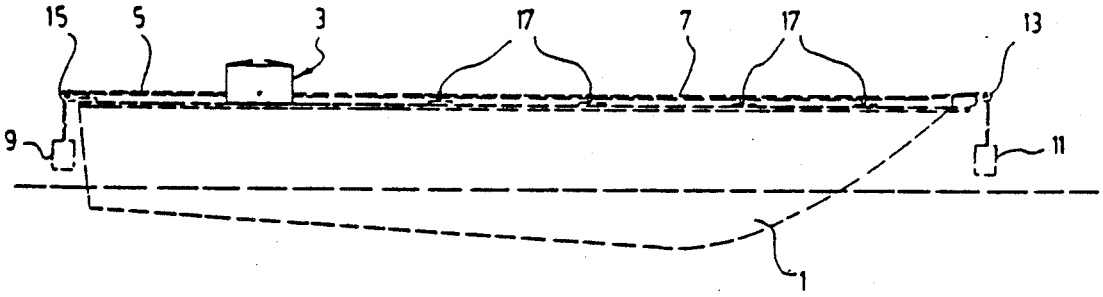
FIG. 1 is a side elevation view of a light boat provided with an anchoring device according to a first preferred embodiment of the invention.

FIG. 1 shows a row boat or light motor boat 1 provided, at the top of one of its sideboards, with an anchoring device 3 made according to a first preferred embodiment of the invention. As shown in this Figure, the device 3 comprises an aft cable 5 and a fore cable 7 with anchors 9, 11, attached to them. The anchors can be of any type, as desired by the user. For example, the anchors can be in the form of concrete weights. The cables, which are preferably made of nylon, wind around fore and aft pulleys 13, 15, after threading through eyelets 17 also fixed to the top edge of the sideboard.

Figure 2:
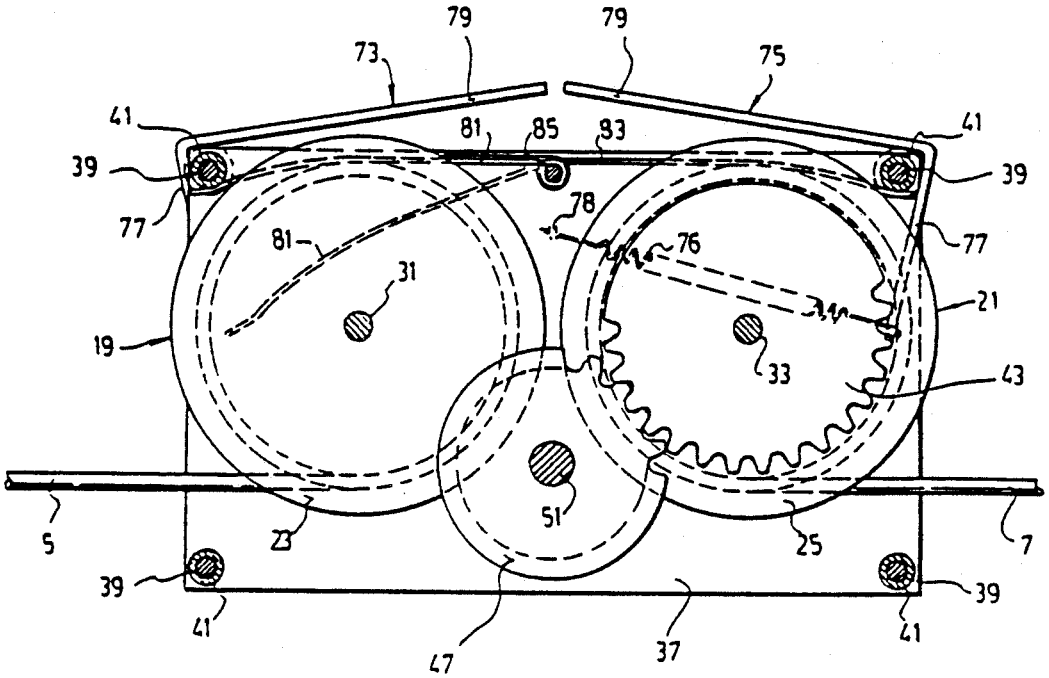
FIG. 2 is a side elevation view of the anchoring device shown in FIG. 1, with the front plate of the frame removed.
Figure 3:
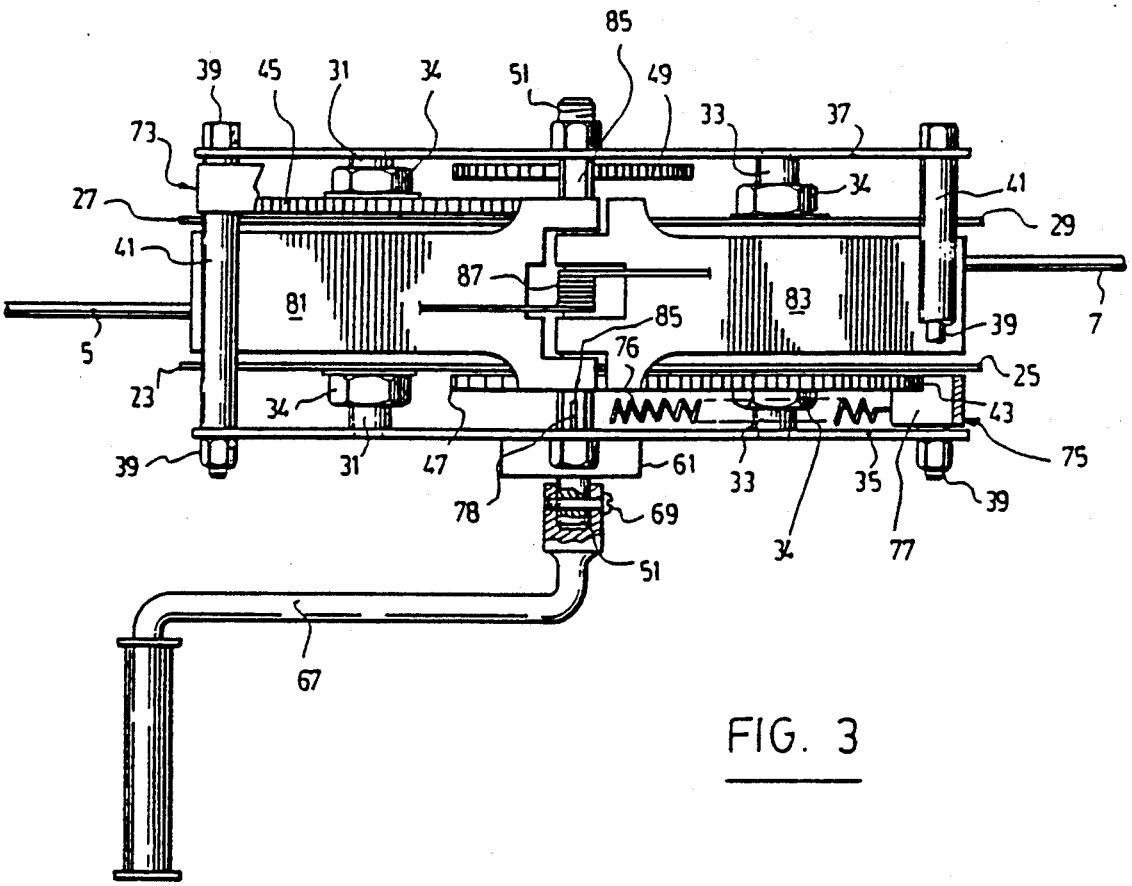
FIG. 3 is a top plan view of the anchoring device shown in FIGS. 1 and 2.

Referring to FIGS. 2 and 3, it is seen that the cables 5, 7, are respectively wound into rolls (not shown) on a pair of aligned winch drums 19, 21, each having a front and a rear circular cheek disk. The front disks 23, 25, of the drums 19, 21, are coplanar and the rear disks 27, 29, are likewise coplanar. The mounting of the cables on the drums is such that they wind and unwind in opposite directions. The disks are fixed to a pair of parallel axles in the form of spindles 31, 33, by bolt means 34 and the spindles are respectively suitably journaled in a forward rectangular side plate 35 and in a rearward rectangular side plate 37 of the frame of the device 3. The plates are connected together, at their corners, by transverse bolt-and-nut assemblies of which the bolts 39 may be covered by sleeves 41.

Figure 4:
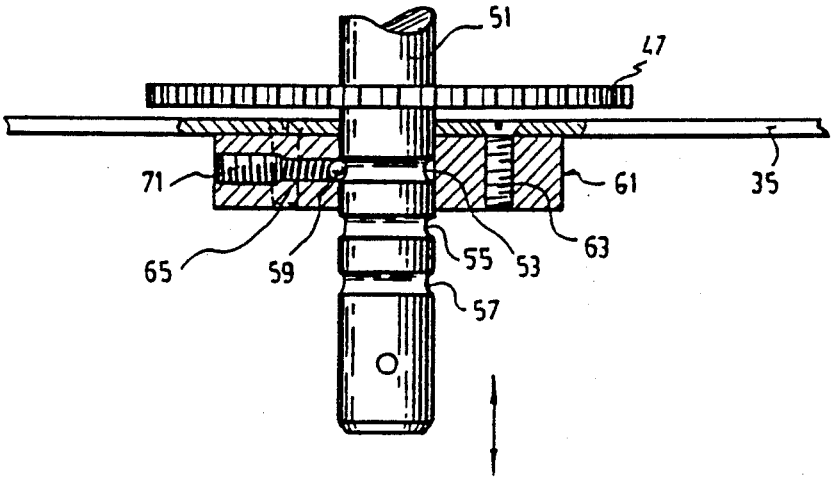
FIG. 4 is a top plan view of the positioning device of the operating shaft of the anchoring device according to the invention.

As said before, means that are to be operated manually are provided on the winch drums 19, 21, and on the frame side plates 35, 37, for rotating the drums and, in neutral position, for allowing the drums to idle and let the anchors 9, 11, drop to the water bottom. For this purpose, the front disk 25 of the winch drum 21 has, fixed to it, a first driven gear 43 and the rear disk 27 (FIG. 3) of the winch drum 19 has, also fixed to it, a second driven gear 45; both gears being coaxial with their respective disk. The driven gears and therefore the drums are rotated by a pair of pinions, 47 for the gear 43 and 49 for the gear 45, secured on an operating shaft 51 mounted for rotation and for axial displacement on the frame plates 35 and 37. For controlling the axial displacement the shaft 51, the latter is formed with three spaced circumferential arcuate grooves 53, 55 and 57 (FIG. 4) for receiving a ball 59 of a ball lock 61 fixed by screws 63 to the forward side plate 35 of the frame. With proper positioning of the gear 47, 49, on the shaft 51, the spring-biased ball 59 can then selectively engage in any one of the three grooves 53, 55 and 57 upon axial manual displacement of the shaft 51 to hold it in three different positions: a first position corresponding to the groove 53 where the pinion 49 is in mesh with the gear 45 so that rotation of the shaft 51 causes rotation of the second driven gear 45 of the winch drum 19, the other pinion 43 being out of mesh with the first driven gear 47; a second or neutral position corresponding to the groove 55 where both driven gears are out of mesh with their corresponding pinions 43 and 45 causing the drums 19, 21, to idle, and a third position corresponding to the groove 57 where the first pinion 47 meshes with the driven gear 43 so that rotation of the shaft 51 causes rotation of the first driven gear 43 and so of the winch drum 21. The third position is that illustrated in FIGS. 2 and 3. Manual rotation of the shaft 51 is obtained by means of a crank lever 67 removably mounted on the shaft by a threaded bolt 69. Adjustment of the bias of the ball spring 65, on the other hand, is by means of a set screw 71.

A pair of pawl members 73, 75, are provided on the frame to prevent reverse rotation of the winch drums 19, 21, and thus unwinding of the cables 5, 7, under the weight of the anchors 9, 11. They are pivotally mounted on the top ones of the bolts 39 securing the frame side plates 35, 37, together and, as seen in FIGS. 2 and 3, they consist of bell-crank levers of which a locking branch 77 engages with a tooth of a relevant driven gear 43, 45, while an operating branch 79 extends toward the center of the device 3. These pawl members therefore serve to hold the anchor weights 9, 11, in raised position when not needed, as shown in FIG. 1, but also permit rotation of the winch drums in the forward direction for winding the cable on the winch drums. A return spring 76 connecting the lower end of the locking branch 77 to a bracket 78 of the frame side plate 35 serves to bias the branch 77 against the driven gear 43. A like return spring (not shown) is provided with respect to the other pawl 73 and the driven gear 45. These return spring arrangements are of course necessary to prevent undue unwinding of the drums under the weight of the anchors. On the other hand, pressing the operating branches 79 down will release the driven gears 43, 45, and allow the cables to unwind rapidly and the anchors to drop to the bottom of the water.

The anchoring device 3 according to the first embodiment of the invention finally comprises a momentum-breaking arrangement which acts on the cable rolls. It serves to control and stop rotation of the drums, particularly causing them to loose their momentum immediately when the anchors reach the bottom of the water and stop suddenly. This of course prevents loosening of the cables and drifting of the boat. The arrangement consists of a pair of friction arms 81, 83, of which one end is mounted on a common pivot axle 85, located centrally between the drums 19, 21, and mounted on the frame side plates 35, 37, parallel to spindles 31, 33, and transverse bolts 39. The other ends of the arms are frictionally applied over the cable rolls of the drums. Frictional pressure is obtained by a spring 87 coiled about the common axle 85 with its ends forceably applied and pressing the friction arms 81, 83, against the cable rolls. Thus, the spring keeps a constant pressure on the rolls as illustrated in dotted lines in FIG. 2. The friction arms 81, 83, are preferably arcuate at their pressing ends to apply over as great a surface of the cable rolls as possible. For the same reason of maximizing the frictional pressure without of course hindering rotation of the drums, the arms should have a width about equal to that of the cable rolls. As can be appreciated, the friction arms 81, 83, also serve to ensure proper winding of the cables over the width of the winch drums.

The anchoring device 3 may be removably secured to the upper edge of the sideboard of the boat 1 by a support plate (not shown) fixed to the sideboard edge and having an integral arcuate bent end straddling one of the bottom sleeves 41 (FIG. 2) while an arcuate clamp straddles the other bottom sleeve 41 and is removably secured to the support plate.

Figure 6:
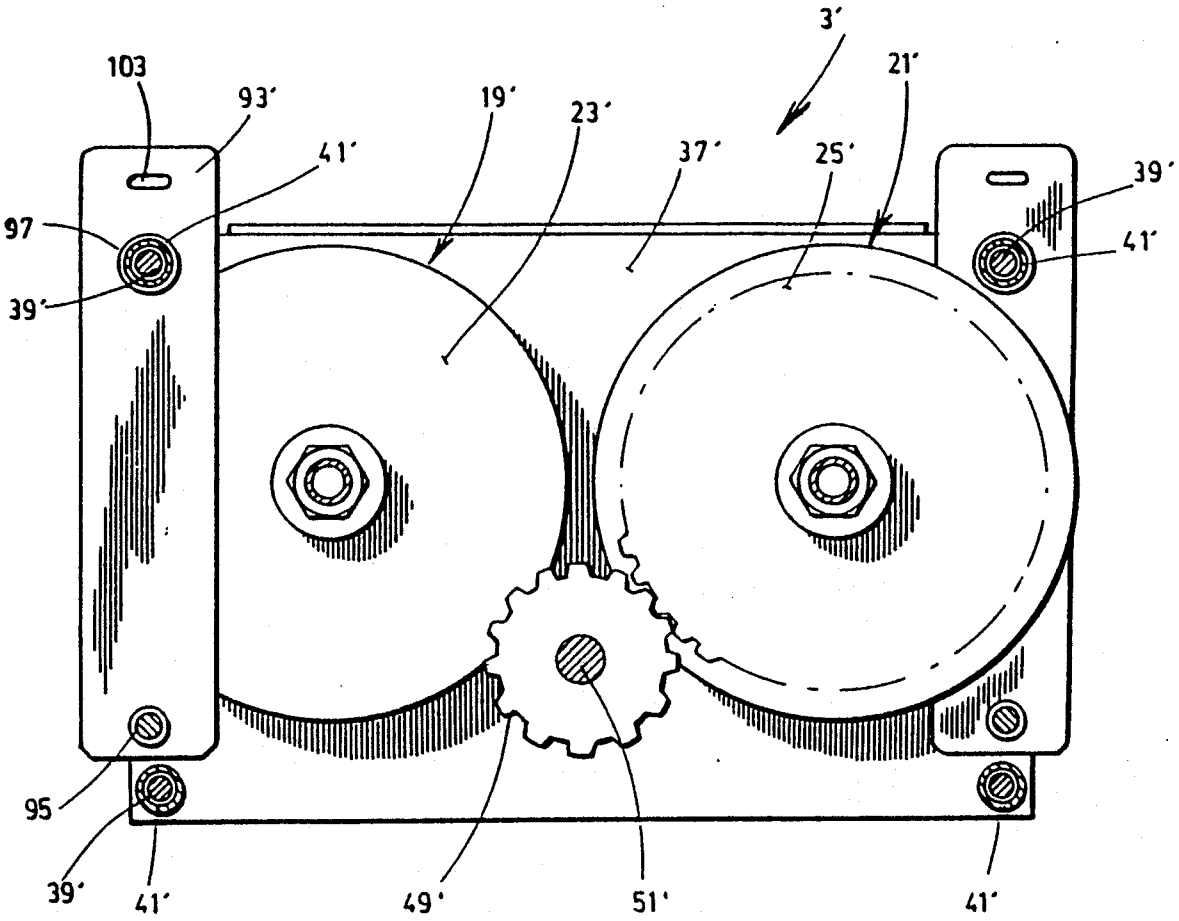
FIG. 6 is a cross-sectional, side elevation view taken along; line VI—VI of FIG. 5.
Figure 5:
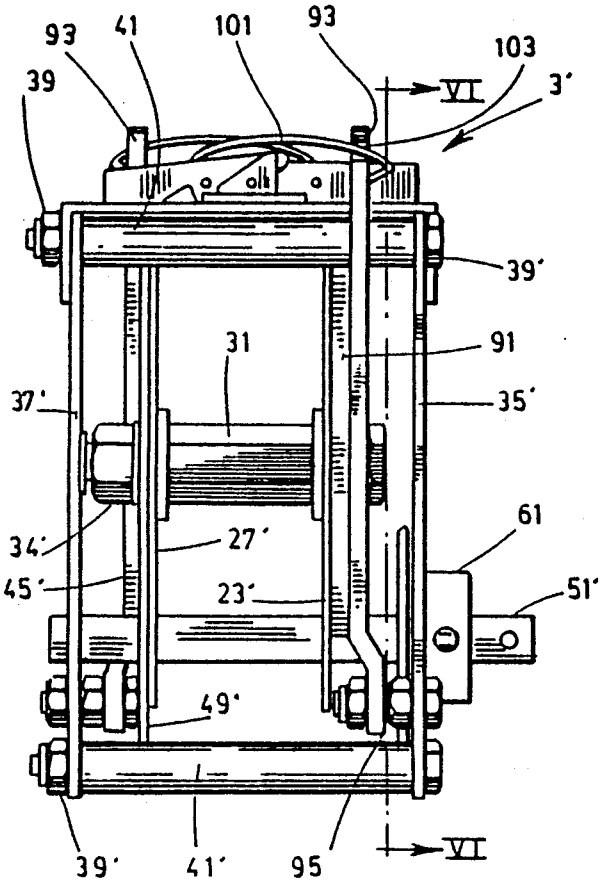
FIG. 5 is a front elevation view of an anchoring device according to a second preferred embodiment of the invention.

FIGS. 5 and 6 show an anchoring device 3' according to a second preferred embodiment of the invention. The basic structure and operation of this device 3' being substantially identical to those of the device 3 previously disclosed, the same reference numerals have been used in the drawings to identify the same structural elements, with a distinguishing "prime".

As will be noted, this second embodiment is very similar to the first one, except for the manually releasable stopping means which is of a completely different structure, and acts not only as such, i.e. as stopping means, but also as momentum-breaking means.

More particularly, in this second embodiment, the stopping means comprises, for each of the drums, say 19', a friction lining pad 91 similar to those used in the brakes of a car, which pad is mounted onto an operating lever 93 extending vertically inside the device 3', between a portion of the cheek disk 23' and the adjacent side plate 35'. The lever 93 has a lower end slackly mounted onto a pin 95 fixed to the side plate 35' over the lever bolt and sleeve assembly 39', 41' that is close to the drum 19'. The lever 93 also has an upper end which extends upwardly out of the frame of the device 3'. This lever 93 is held in upward position by means of the upper bolt and sleeve assembly 39', 41', that is adjacent to the drum 19' and passes through a large hole 97 provided for this purpose in the lever 93 (FIG. 6).

The stopping means also comprises means acting on the lever 93 to bias the pad 91 against the external surface cheek disk 23'. These means may consist of a detachable spring leaf 99 that is fixed into a hole 103 in the lever 93 and is hookable onto a rigid element on top of the device 3' as is shown in FIG. 5.

As can be understood, release of the spring leaf 99 will release the lever 93 and thus release of the drum 19'. Of course, one keeping the hand onto the upper end of the lever 93 will be able not only to free the drum 19' but to break the same whenever desired by properly adjusting the amount of pressure exerted onto the drum by the pad 91'.

What is claimed is:

1. An anchoring device comprising:

a frame;

a pair of winch drums and cables for attaching to anchors, said cables being wound into rolls on said drums for winding and unwinding in opposite directions;

means rotatably mounting said drums on said frame;

manually operable means on said drums and on said frame for rotating said drums and, in neutral position of said operable means, for allowing said drums to idle; and manually releasable stopping means on said frame for stopping rotation of said drums to prevent said cables from unwinding therefrom, wherein said manually operable means comprise:

a first driven gear fixed to one of said drums and a second driven gear fixed to the other of said drums;

an operating shaft mounted for rotation and axial displacement on said frame and having a pair of pinions fixed thereto;

means controlling said axial displacement of said shaft between a first position wherein one of said pinions meshes with said first driven gear; a second position wherein both of said pinions are free of said gears; and a third position wherein the other of said pinions meshes with said second driven gear, said operating shaft being formed with three spaced circumferential lock grooves, said control means comprising a ball lock including a spring-biased ball engageable in said grooves to hold said shaft selectively in any of said three positions.

2. An anchoring device as claimed in claim 1, wherein said manually operable means further comprise a crank lever releasably mounted on said shaft for rotating same.

3. An anchoring device as claimed in claim 2, wherein said winch drums are mounted in alignment on said frame for rotation about parallel axes.

4. An anchoring device as claimed in claim 2, wherein:

each drum comprises a pair of parallel cheek disks;

the driven gears of said manually operable means are extremely fixed to one of said cheek disks, and said manually releasable stopping means comprise, for each of said drums, a pawl member pivotally mounted on said frame for engaging with a tooth of said driven gear, and means biasing said pawl against said driven gear.

5. An anchoring device as claimed in claim 2, wherein:

each drum comprises a pair of parallel cheek disks;

the driven gears of said manually operable means are externally fixed to one of said cheek disks, and said manually releasable stopping means comprise, for each of said drums, a friction lining pad mounted onto an operating lever and means acting on said lever to bias said pad against the other cheek disk.

6. An anchoring device as claimed in claim 5, further comprising:

means to hook each operating lever in a position where the pad does not bear against said other cheek disk.

7. An anchoring device comprising:

a frame;

a pair of winch drums and cables for attaching to anchors, said cables being wound into rolls on said drums for winding and unwinding in opposite directions;

means rotatably mounting said drums on said frame;

manually operable means on said drums and on said frame for rotating said drums and, in neutral position of said operable means, for allowing said drums to idle; and manually releasable stopping means on said frame for stopping rotation of said drums to prevent said cables from unwinding therefrom, wherein said manually operable means comprise:

a first driven gear fixed to one of said drums and a second driven gear fixed to the other of said drums;

an operating shaft mounted for rotation and axial displacement on said frame and having a pair of pinions fixed thereto;

means controlling said axial displacement of said shaft between a first position wherein one of said pinions meshes with said first driven gear; a second position wherein both of said pinions are free of said gears; and a third position wherein the other of said pinions meshes with said second driven gear, and wherein:

said frame comprises a pair of parallel side plates on which said drums are pivotably mounted;

the first driven gear is fixed to the forward disk of one of said drums and a second driven gear is fixed to the rearward disk of the other drum; and the operating shaft is rotatably and axially displaceably mounted on said frame side plates and the pair of pinions is fixed to said shaft on either side of said drums inwardly of said frame side plates.

8. An anchoring device as claimed in claim 7, wherein said shaft is formed with three spaced circumferential lock grooves and said control means comprise a ball lock including a spring-biased ball engageable in said grooves to hold said shaft selectively in said three positions.

9. An anchoring device as claimed in claim 8, wherein said manually operable means further comprise a crank lever releasably mounted on said shaft for rotating same.

10. An anchoring device as claimed in claim 9, wherein the side plates of said frame are connected together by transverse bolt-and-nut assemblies at the upper and lower corners of said side plates.

11. An anchoring device as claimed in claim 7, wherein said winch drums are mounted in alignment on said frame side plates for rotation about parallel axes.

12. An anchoring device as claimed in claim 7, wherein:

each drum comprises a pair of parallel cheek disks;

the driven gears of said manually operable means are extremely fixed to one of said cheek disks, and said manually releasable stopping means comprise, for each of said drums, a friction lining pad mounted onto an operating lever and means acting on said lever on bias said pad against the other cheek disk.

13. An anchoring device comprising:

a frame;

a pair of winch drums and cables for attaching to anchors, said cables being wound into rolls on said drums for winding and unwinding in opposite directions;

means rotatably mounting said drums on said frame;

manually operable means on said drums and on said frame for rotating said drums and, in neutral position of said operable means, for allowing said drums to idle; and manually releasable stopping means on said frame for stopping rotation of said drums to prevent said cables from unwinding therefrom, wherein said manually operable means comprise:

a first driven gear fixed to one of said drums and a second driven gear fixed to the other of said drums;

an operating shaft mounted for rotation and axial displacement on said frame and having a pair of pinions fixed thereto;

means controlling said axial displacement of said shaft between a first position wherein one of said pinions meshes with said first driven gear; a second position wherein both of said pinions are free of said gears; and a third position wherein the other of said pinions meshes with said second driven gear, and wherein said device further comprises:

momentum-breaking means on said frame acting on said cable rolls and capable of stopping said drums for allowing said drums to loose said momentum when anchors carried by said cables come to a sudden stop.

14. An anchoring device as claimed in claim 13, wherein said momentum-breaking means comprise:

a pair of friction arms, each arm having one end mounted on said frame for pivotal movement about an axis parallel to the axes of said drums and the other end frictionally applied over the cable roll of one of said drums, and resilient means biasing said arms against said rolls.

15. An anchoring device as claimed in claim 14, wherein said friction arms are mounted on a common pivot axle fixed onto said frame between the drums and have a width about equal to said cable rolls, and wherein said resilient means comprise a spring coiled about said axle with the end thereof applied over and pressing said arms against said cable rolls.

16. An anchoring device comprising:

a frame;

a pair of winch drums and cables for attaching to anchors, said cables being wound into rolls on said drums for winding and unwinding in opposite directions;

means rotatably mounting said drums on said frame;

manually operable means on said drums and on said frame for rotating said drums and, in neutral position of said operable means, for allowing said drums to idle; and manually releasable stopping means on said frame for stopping rotation of said drums to prevent said cables from unwinding therefrom, wherein said manually operable means comprise:

a first driven gear fixed to one of said drums and a second driven gear fixed to the other of said drums;

an operating shaft mounted for rotation and axial displacement on said frame and having a pair of pinions fixed thereto;

means controlling said axial displacement of said shaft between a first position wherein one of said pinions meshes with said first driven gear; a second position wherein both of said pinions are free of said gears; and a third position wherein the other of said pinions meshes with said second driven gear, and wherein:

each drum comprises a pair of parallel cheek disks;

the driven gears of said manually operable means are externally fixed to one of said cheek disks, and said manually releasable stopping means comprise, for each of said drums, a pawl member pivotally mounted on said frame for engaging with tooth of said driven gear, and means biasing said pawl against said driven gear.

17. An anchoring device comprising:

a frame;

a pair of winch drums and cables for attaching to anchors, said cables being wound into rolls on said drums for winding and unwinding in opposite directions;

means rotatably mounting said drums on said frame;

manually operable means on said drums and on said frame for rotating said drums and, in neutral position of said operable means, for allowing said drums to idle; and manually releasable stopping means on said frame for stopping rotation of said drums to prevent said cables from unwinding therefrom, wherein said manually operable means comprise:

a first driven gear fixed to one of said drums and a second driven gear fixed to the other of said drums;

an operating shaft mounted for rotation and axial displacement on said frame and having a pair of pinions fixed thereto;

means controlling said axial displacement of said shaft between a first position wherein one of said pinions meshes with said first driven gear; a second position wherein both of said pinions are free of said gears; and a third position wherein the other of said pinions meshes with said second driven gear, and wherein:

each drum comprises a pair of parallel cheek disks;

the driven gears of said manually operable means are externally fixed to one of said cheek disks, and said manually releasable stopping means comprise, for each of said drums, a friction lining pad mounted onto an operating lever and means acting on said lever to bias said pad against the other cheek disk.

18. An anchoring device as claimed in claim 17, further comprising:

means to hook each operating lever in a position where the pad does not bear against said other cheek disk.

* * * * *